US006702513B1

(12) United States Patent
Raupach

(10) Patent No.: US 6,702,513 B1
(45) Date of Patent: Mar. 9, 2004

(54) IMPACT BARRIER

(76) Inventor: James E. Raupach, 2444 11th St., Cuyahoga Falls, OH (US) 44221

( * ) Notice: Subject to any disclaimer, the term of this patent is extended or adjusted under 35 U.S.C. 154(b) by 11 days.

(21) Appl. No.: 10/392,774

(22) Filed: Mar. 20, 2003

(51) Int. Cl.[7] ..... E01F 9/00
(52) U.S. Cl. ..... 404/6; 404/10; 256/13.1
(58) Field of Search ..... 404/6, 10; 256/13.1; 188/377, 371

(56) References Cited

U.S. PATENT DOCUMENTS 1,449,518 A * 3/1923 Lawson ..... 256/13.1
2,187,556 A * 1/1940 Gill ..... 256/13.1
3,540,699 A * 11/1970 Guzzardella ..... 256/13.1
4,674,911 A * 6/1987 Gertz ..... 404/6
4,681,302 A * 7/1987 Thompson ..... 256/13.1
5,192,157 A * 3/1993 Laturner ..... 404/6
5,301,990 A * 4/1994 Willeford ..... 293/107
6,276,667 B1 * 8/2001 Arthur ..... 256/13.1

* cited by examiner

*Primary Examiner*—Gary S. Hartmann

(57) ABSTRACT

An impact barrier provides an impact absorbing wall surface for racecar tracks. The present invention comprises a car-contacting panel having a top edge and a bottom edge. The steel wall bottom edge is disposed in a groove at the periphery of a roadway and a bladder contacts the steel wall. In the case of a car hitting the impact barrier the bladder would deflate and absorb some of the force of the impact.

10 Claims, 4 Drawing Sheets

IMPACT BARRIER

BACKGROUND OF THE INVENTION

1. Field of the Invention

The present invention relates to a impact barrier for use in connection with vehicle crash barrier. The impact barrier has particular utility in connection with decelerating race cars which impact the barrier.

2. Description of the Prior Art

Impact barriers are desirable for absorbing a portion of the energy of deceleration of a vehicle. Safety walls have found wide use on the highway under bridges or on on-ramps to absorb energy from vehicles that collide with the wall. The saving of many lives is directly attributable to these walls. In motor vehicle racing most crashes occur at curves in the track, and the retaining wall in these areas is typically made of concrete. A need has been felt to provide a safety wall for the curves of race tracks that will absorb a portion of the energy of impact when a vehicle collides with it, thus increasing the margin of safety for the drivers.

The use of vehicle crash barrier is known in the prior art. For example, U.S. Pat. No. 5,464,177 to Kramer et al discloses An energy absorbing impact barrier that includes a collapsible energy absorption assembly which is stored in a vault in the ground. Upon deployment, the energy absorption apparatus is lifted out of its vault, where it thereby expands and deploys. The energy absorption apparatus includes four stages of pairs of elastomeric torsion springs configured into scissors arrangements, with each stage having a progressively higher effective spring rate, to thereby decelerate a vehicle which strikes the apparatus. However, the Kramer et al '177 patent does not have a pivot formed within an undercut within a race track periphery and does not have an upstanding wall member positioned via a chain and an airbag contained behind the pivoting wall member.

Similarly, U.S. Pat. No. 5,957,616 to Fitch discloses an inertial impact attenuating barrier and an array thereof particularly useful on race circuits. The frangible barrier includes a thin walled plastic tub containing an energy absorbing dispersible mass such as water or sand, the tub being supported on a thin-walled plastic ring which elevates the dispersible mass to a height at which its center of gravity is the same as the center of gravity of a particular type racecar. However, the Fitch '616 patent does not have a pivot formed within an undercut within a race track periphery and does not have an upstanding wall member positioned via a chain and an airbag contained behind the pivoting wall member.

Lastly, U.S. Pat. No. 5,645,368 to Yunick discloses a Race track with novel crash barrier and method that has a tri-oval banked, racing surface surrounded by a barrier support material delineating a race barrier support surface at a level below the racing surface. A plurality of barrier modules are mounted on the support surface in longitudinally aligned relationship to delineate two crash barrier rings circumscribing the racing surface. Each of the modules includes a base mounted on the barrier support surface with the inner ring in juxtaposed relationship with the racing surface. Each base includes a top surface substantially in elevational alignment with a perimetral portion of the racing surface. Each module includes a vehicle impact energy absorbing means mounted on and connected to its base for cushioning energy absorption upon impact by an out of control race vehicle; and, each module base and a portion of the barrier support material upon which that module is mounted together forming a further vehicle energy absorbing means. A method of conducting vehicle racing contests is also disclosed. The method includes constructing a plurality of race tracks of substantially equal configurations dimensionally, conducting racing events with vehicles each equipped with power trains and tires respectively constructed to a set of specifications such that competing vehicles have substantially equal performance capabilities, determining the relative position of each competing vehicle at the conclusion of each event, assigning values to the vehicles recording to the position determinations, and, utilizing the assigned values to determine an overall winner of a series of events. However, the Yunick '368 patent does not have a pivot formed within an undercut within a race track periphery and does not have an upstanding wall member positioned via a chain and an airbag contained behind the pivoting wall member.

While the above-described devices fulfill their respective, particular objectives and requirements, the aforementioned patents do not describe a impact barrier that allows decelerating race cars which impact the barrier. The Kramer et al '177, Fitch '616 and Yunick '368 patents makes no provision for a pivot formed within an undercut within a race track periphery and do not have an upstanding wall member positioned via a chain and an airbag contained behind the pivoting wall member.

Therefore, a need exists for a new and improved impact barrier that can be used for decelerating race cars which impact the barrier. In this regard, the present invention substantially fulfills this need. In this respect, the impact barrier according to the present invention substantially departs from the conventional concepts and designs of the prior art, and in doing so provides an apparatus primarily developed for the purpose of decelerating race cars which impact the barrier.

SUMMARY OF THE INVENTION

In view of the foregoing disadvantages inherent in the known types of vehicle crash barrier now present in the prior art, the present invention provides an improved impact barrier, and overcomes the above-mentioned disadvantages and drawbacks of the prior art. As such, the general purpose of the present invention, which will be described subsequently in greater detail, is to provide a new and improved impact barrier and method which has all the advantages of the prior art mentioned heretofore and many novel features that result in a impact barrier which is not anticipated, rendered obvious, suggested, or even implied by the prior art, either alone or in any combination thereof.

To attain this, the present invention essentially comprises a car contacting panel having a top edge and a bottom edge. The car contacting panel bottom edge is disposed upon a roadway and a bladder contacts the car contacting panel.

There has thus been outlined, rather broadly, the more important features of the invention in order that the detailed description thereof that follows may be better understood and in order that the present contribution to the art may be better appreciated.

The invention may also include a retention chain, an inlet valve and a pop off valve. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved impact barrier that has all of the advantages of the prior art vehicle crash barrier and none of the disadvantages.

It is another object of the present invention to provide a new and improved impact barrier that may be easily and efficiently manufactured and marketed.

An even further object of the present invention is to provide a new and improved impact barrier that has a low cost of manufacture with regard to both materials and labor, and which accordingly is then susceptible of low prices of sale to the consuming public, thereby making such impact barrier economically available to the buying public.

Still another object of the present invention is to provide a new impact barrier that provides in the apparatuses and methods of the prior art some of the advantages thereof, while simultaneously overcoming some of the disadvantages normally associated therewith.

Lastly, it is an object of the present invention is to provide a impact barrier for decelerating racecars which impact the barrier.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
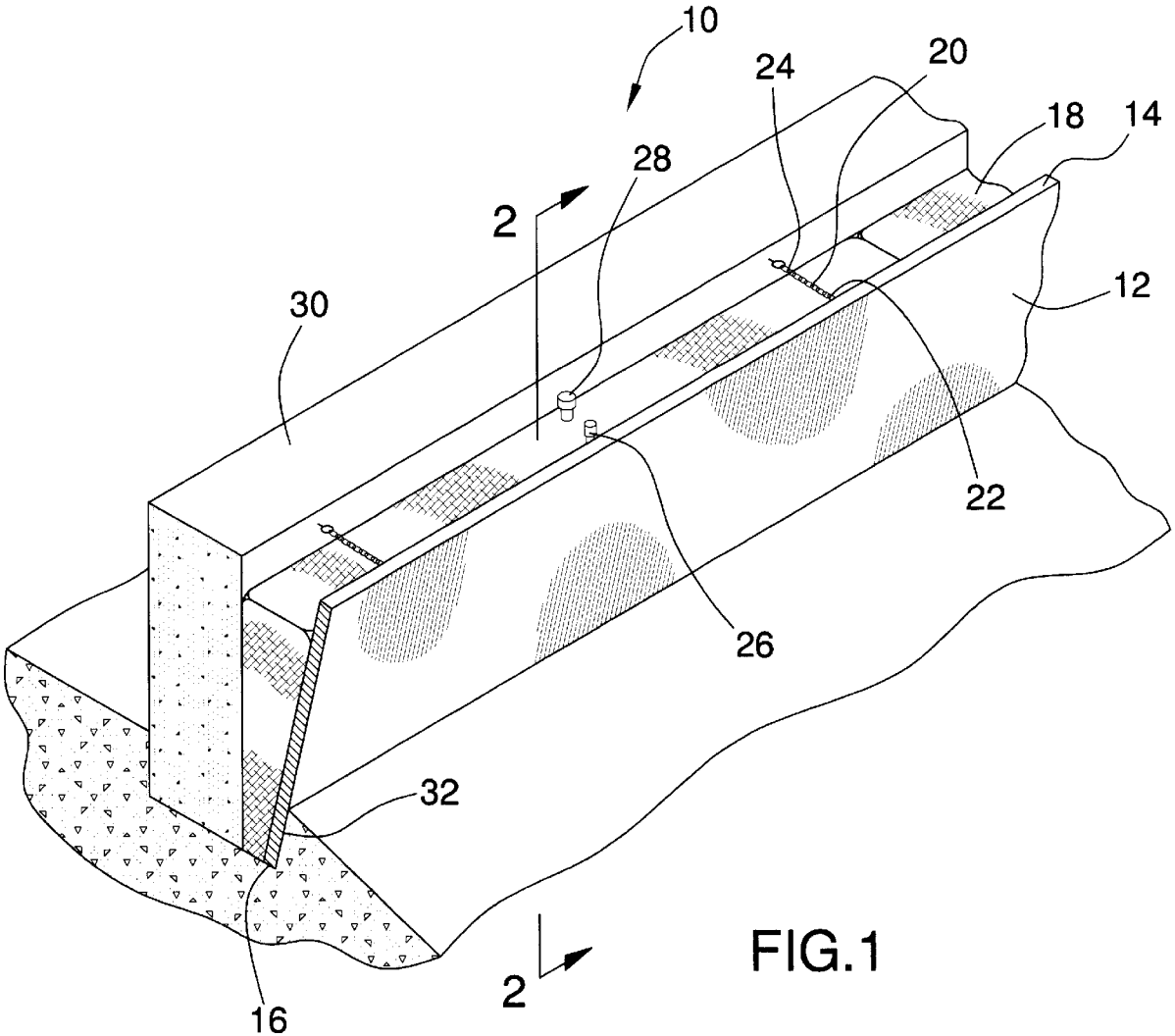
FIG. 1 is a top perspective view of the preferred embodiment of the impact barrier constructed in accordance with the principles of the present invention.

Referring now to the drawings, and particularly to FIGS. 1–4, a preferred embodiment of the impact barrier of the present invention is shown and generally designated by the reference numeral 10.

In FIG. 1, a new and improved impact barrier 10 of the present invention for decelerating race cars which impact the barrier is illustrated and will be described. More particularly, the impact barrier 10 has a car contacting panel 12 having a top edge 14 and a bottom edge 16. The car contacting panel bottom edge 16 is disposed within an undercut groove 32 at the periphery of a roadway. In the preferred embodiment the car contacting panel forms an acute angle with respect to the roadway. In the present example the angle is approximately 20 degrees from perpendicular to the roadway. A bladder 18 contacts the car contacting panel 12. In the present example the wall is 10 feet wide, four feet tall and ½' to ¾' thick steel plate. The bladder 18 is connected to a retaining wall 30. A retention chain 20 has two ends, a car contacting panel end 22 and a retaining wall end 24. The retention chain car contacting panel end 22 is connected to the car contacting panel 12 adjacent to the car contacting panel top edge 14. The retention chain retaining wall end 24 is connected to the retaining wall 30. An inlet valve 26 is connected to the bladder 18. A pop off valve 28 is connected to the bladder 18.

Figure 2:
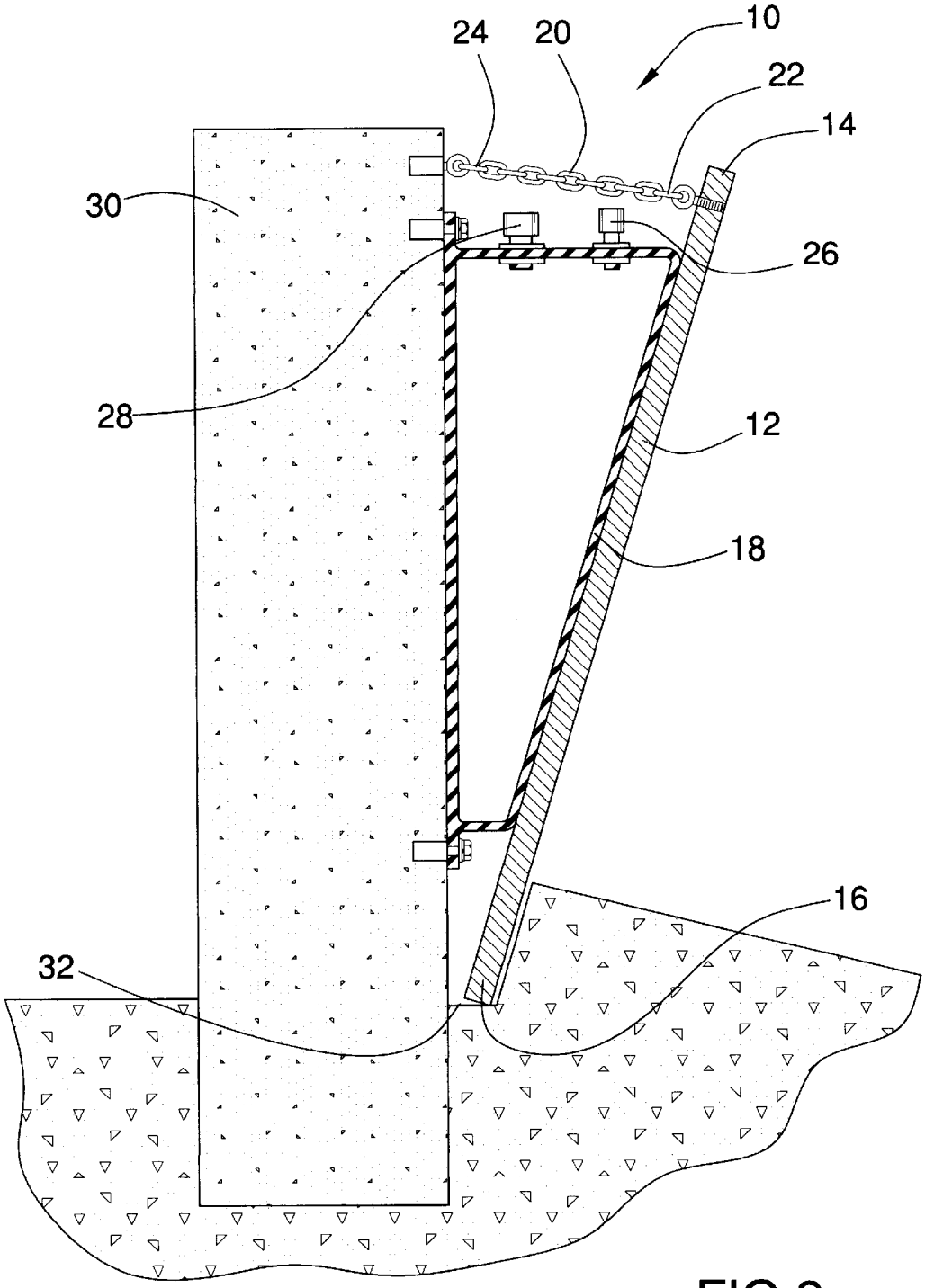
FIG. 2 is a section 2—2 view of FIG. 1 of the impact barrier of the present invention.

In FIG. 2, the impact barrier 10 is illustrated and will be described. The impact barrier 10 has the car contacting panel 12 having the top edge 14 and the bottom edge 16. The car contacting panel bottom edge 16 is disposed within the undercut groove 32 at the periphery of the roadway. In the preferred embodiment the car contacting panel forms an acute angle with respect to the roadway. The bladder 18 contacts the car contacting panel 12. The bladder 18 is connected to the retaining wall 30. The retention chain 20 has two ends, the car contacting panel end 22 and the retaining wall end 24. The retention chain car contacting panel end 22 is connected to the car contacting panel 12 adjacent to the car contacting panel top edge 14. The retention chain retaining wall end 24 is connected to the retaining wall 30. The inlet valve 26 is connected to the bladder 18. The pop off valve 28 is connected to the bladder 18.

Figure 3:
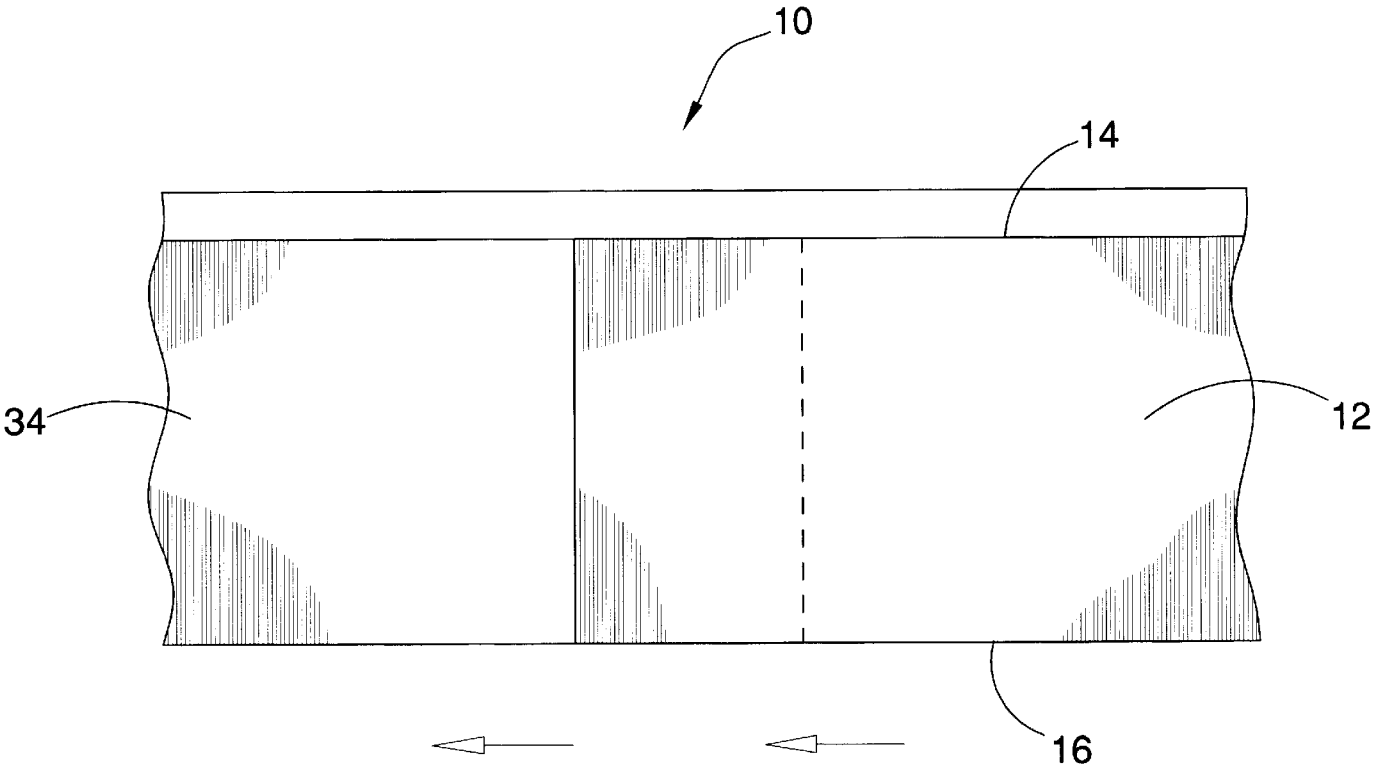
FIG. 3 is a front side view of the impact barrier of the present invention.

In FIG. 3, the impact barrier 10 is illustrated and will be described. The impact barrier 10 has the car contacting panel 12 having the top edge 14 and the bottom edge 16. The car contacting panel 12 is capable of overlapping a second car contacting panel 34.

Figure 4:
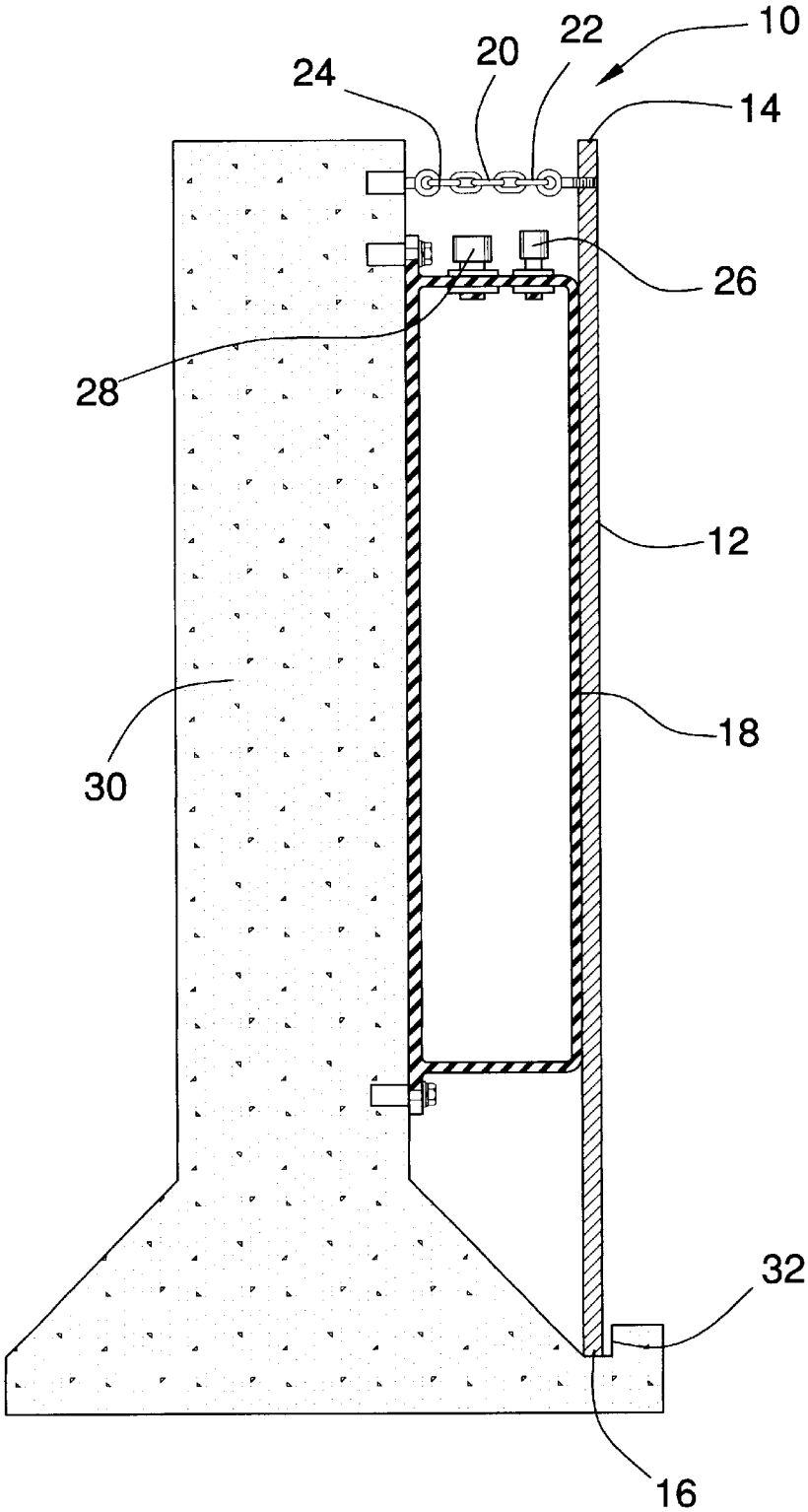
FIG. 4 is a section view of a second embodiment of the impact barrier of the present invention.

In FIG. 4, the impact barrier 10 is illustrated and will be described. The impact barrier 10 has the car contacting panel 12 having the top edge 14 and the bottom edge 16. The car contacting panel bottom edge 16 is disposed within the undercut groove 32 at the periphery of the roadway. In the second embodiment the car contacting panel forms a right angle with respect to the roadway. The bladder 18 contacts the car contacting panel 12. The bladder 18 is connected to the retaining wall 30. The retention chain 20 has two ends, the car contacting panel end 22 and the retaining wall end 24. The retention chain car contacting panel end 22 is connected to the car contacting panel 12 adjacent to the car contacting panel top edge 14. The retention chain retaining wall end 24 is connected to the retaining wall 30. The inlet valve 26 is connected to the bladder 18. The pop off valve 28 is connected to the bladder 18.

In use it can now be understood that when a race car contacts the car contacting panel 12 upon impact, the bladder 18 compresses and the pop off valve 28 releases air from the bladder in a controlled fashion to allow deflation of the bladder 18.

While a preferred embodiment of the impact barrier has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable compressible material such foam may be used instead of the air bag described. And although use by decelerating racecars has been described, it should be appreciated that the impact barrier herein described is also suitable for a highway crash barrier.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An impact barrier comprising:

a car contacting panel having a top edge and a bottom edge, said bottom edge is disposed within an undercut groove at the periphery of a roadway; and a bladder contacting said car contacting panel.

2. The impact barrier of claim 1 wherein:

said bladder is connected to a retaining wall.

3. The impact barrier of claim 2 further comprising:

a retention chain connected to said car contacting panel adjacent to said car contacting panel top edge.

4. The impact barrier of claim 3 wherein:

said retention chain has two ends, a car contacting panel end and a retaining wall end, said retention chain car contacting panel end is connected to said car contacting panel adjacent to said car contacting panel top edge.

5. The impact barrier of claim 4 further comprising:

an inlet valve connected to said bladder.

6. The impact barrier of claim 5 further comprising:

a pop off valve connected to said bladder.

7. The impact barrier of claim 6 wherein:

said car contacting panel is capable of overlapping a second car contacting panel.

8. The impact barrier of claim 7 wherein:

said car contacting panel forms an acute angle with respect to said roadway.

9. The impact barrier of claim 7 wherein:

said car contacting panel forms a right angle with respect to said roadway.

10. An impact barrier comprising:

a car contacting panel having a top edge and a bottom edge, said bottom edge is disposed within an undercut groove at the periphery of a roadway, said car contacting panel is capable of overlapping a second car contacting panel;

a bladder contacting said car contacting panel, said bladder is connected to a retaining wall;

a retention chain having two ends, a car contacting panel end and a retaining wall end, said retention chain car contacting panel end is connected to said car contacting panel adjacent to said car contacting panel top edge, said retention chain retaining wall end is connected to said retaining wall;

an inlet valve connected to said bladder; and a pop off valve connected to said bladder.

* * * * *